US010994406B2

(12) United States Patent
Jeltsch et al.

(10) Patent No.: US 10,994,406 B2
(45) Date of Patent: May 4, 2021

(54) SYSTEM COMPRISING AN ELECTRICALLY OPERATED HANDHELD DEVICE AND A TRANSPORT CASE FOR THE HANDHELD DEVICE, AND METHOD FOR OPERATING A HANDHELD DEVICE

(71) Applicant: WAGNER SPRAYTECH (UK) LTD., Surrey (GB)

(72) Inventors: Thomas Jeltsch, Friedrichshafen (DE); Paul Van Der Rest, Surrey (GB); Dan Byne, West Sussex (GB); Philip Paice, Surrey (GB)

(73) Assignee: Wagner Spraytech (UK) Ltd., Surrey (GB)

( * ) Notice: Subject to any disclaimer, the term of this patent is extended or adjusted under 35 U.S.C. 154(b) by 352 days.

(21) Appl. No.: 16/002,133

(22) Filed: Jun. 7, 2018

(65) Prior Publication Data

US 2018/0339408 A1 Nov. 29, 2018

Related U.S. Application Data

(63) Continuation of application No. PCT/EP2016/081200, filed on Dec. 15, 2016.

(30) Foreign Application Priority Data

Dec. 15, 2015 (DE) ..... 10 2015 121 891.7

(51) Int. Cl.
*B25H 3/02* (2006.01)
*B24B 23/00* (2006.01)
(Continued)

(52) U.S. Cl.
CPC ..... *B25H 3/02* (2013.01); *B24B 23/005* (2013.01); *F24H 3/0423* (2013.01)

(58) Field of Classification Search
None
See application file for complete search history.

(56) References Cited

U.S. PATENT DOCUMENTS 2,516,378 A * 7/1950 Fletcher ..... A45D 20/14 34/99
2,817,000 A * 12/1957 Scheid ..... A45D 20/08 392/383

(Continued)

FOREIGN PATENT DOCUMENTS

DE 90 14 132 U1 1/1991
DE 202 12 331 U1 11/2002

(Continued)

OTHER PUBLICATIONS

English translation of International Preliminary Report on Patentability (Application No. PCT/EP2016/081200) dated Jun. 28, 2018 (Chapter I).

(Continued)

*Primary Examiner* — Thor S Campbell
(74) *Attorney, Agent, or Firm* — Burr & Brown, PLLC

(57) ABSTRACT

The invention relates to a system which comprises an electrically operated handheld device, which particularly takes the form of a hot-air handheld device or handheld grinding device, and a transport case for the handheld device, wherein the transport case comprises at least one first case shell. Here, the at least one first case shell comprises an outer side, the case shell comprising in its outer side a depression for partially accommodating the handheld device, and the depression extending in the direction of a stowage space of the transport case.

10 Claims, 6 Drawing Sheets

(51) Int. Cl.
*F24F 3/04* (2006.01)
*F24H 3/04* (2006.01)

(56) References Cited

U.S. PATENT DOCUMENTS 3,115,567 A * 12/1963 Meltzer ..... B44D 3/168 392/384
3,298,111 A * 1/1967 Parr ..... H05B 3/16 34/99
3,377,715 A * 4/1968 Hubner ..... A45D 20/18 34/99
3,386,184 A * 6/1968 Ponczek ..... A45D 20/10 34/99
3,686,774 A * 8/1972 Beadle, Jr. ..... F26B 9/003 34/227
3,727,322 A * 4/1973 Walter ..... A45D 20/44 34/99
3,731,396 A * 5/1973 McLean ..... A45D 20/44 34/99
3,745,306 A * 7/1973 Naritomi ..... A45D 19/16 392/335
4,279,342 A * 7/1981 Van Pelt ..... A45C 15/00 206/542
4,366,368 A * 12/1982 Stephens, III ..... F24H 3/062 15/405
4,611,713 A * 9/1986 Byrns ..... B25H 3/006 206/303
4,635,382 A * 1/1987 Bourdeau ..... A45D 20/06 126/401
4,703,852 A 11/1987 Verdier
4,757,183 A * 7/1988 Karey ..... A45D 20/10 392/341
4,904,847 A * 2/1990 Kosaka ..... A45D 20/12 392/384
4,910,385 A * 3/1990 Shye-Long ..... A45D 20/12 200/332.2
4,939,345 A * 7/1990 Farina ..... A45D 20/10 34/97
5,124,532 A * 6/1992 Hafey ..... A45D 1/00 132/229
5,195,253 A * 3/1993 Poumey ..... A45D 20/04 34/97
5,339,956 A * 8/1994 Thomason ..... B25H 3/023 206/372
5,394,620 A * 3/1995 Chimera ..... A45D 20/10 34/97
5,447,041 A * 9/1995 Piechota ..... A45C 11/20 206/542
5,810,168 A * 9/1998 Eggering ..... A45C 15/00 206/372
5,884,008 A * 3/1999 Goldberg ..... A45D 20/12 206/320
D417,338 S * 12/1999 Main ..... D3/276
6,314,236 B1 * 11/2001 Taylor ..... A45D 20/10 200/50.01
6,571,949 B2 * 6/2003 Burrus, IV ..... B25H 3/02 206/373
6,626,295 B1 * 9/2003 Vasudeva ..... B25H 3/023 206/373
6,662,945 B1 * 12/2003 Chang ..... B25H 3/006 206/372
6,732,449 B2 * 5/2004 Evanyk ..... A45D 20/12 34/96
6,928,235 B2 * 8/2005 Pollack ..... A47K 10/48 34/90
7,170,035 B2 * 1/2007 Peterson ..... B25H 3/02 206/373
7,380,347 B2 * 6/2008 Coats ..... A45D 20/12 34/97
7,456,609 B2 * 11/2008 Fuchs ..... B25F 5/00 320/114
7,471,883 B2 * 12/2008 Seutter ..... A47K 10/48 34/90
8,415,921 B1 * 4/2013 Young ..... H02J 7/0045 320/112
8,439,192 B2 * 5/2013 Goto ..... B25H 3/02 206/349
8,599,097 B2 * 12/2013 Intravatola ..... F41A 23/14 343/881
2002/0030425 A1 3/2002 Tiramani et al.
2002/0104709 A1 * 8/2002 Hines ..... B25H 3/006 182/129
2003/0089630 A1 * 5/2003 Cooper ..... B25H 3/006 206/349
2005/0161357 A1 * 7/2005 Allan ..... B25H 1/005 206/373
2005/0200087 A1 * 9/2005 Vasudeva ..... B25F 3/00 279/143
2006/0201834 A1 * 9/2006 Lutz ..... B25H 3/006 206/372
2006/0260964 A1 * 11/2006 Feldmann ..... B25H 3/006 206/373
2008/0083106 A1 4/2008 Elsworthy
2008/0164842 A1 * 7/2008 Bergner ..... B25H 3/006 320/111
2009/0212638 A1 8/2009 Johnson et al.
2009/0212639 A1 8/2009 Johnson et al.
2009/0212737 A1 8/2009 Johnson et al.
2011/0290914 A1 12/2011 Olson et al.
2012/0273377 A1 * 11/2012 Amatrudo ..... B25H 3/006 206/373
2013/0234481 A1 9/2013 Johnson
2015/0263592 A1 * 9/2015 Kawakami ..... H02K 3/522 310/50
2015/0340921 A1 * 11/2015 Suda ..... H02K 7/145 310/50
2016/0211686 A1 * 7/2016 Kovaly ..... H02J 7/0042
2018/0337575 A1 * 11/2018 Sengiku ..... H01R 13/5025

FOREIGN PATENT DOCUMENTS

DE 698 06 605 T2 1/2003
DE 10 2012 111 321 A1 5/2014
DE 10 2012 111 328 A1 5/2014
EP 2 517 840 A2 10/2012
FR 2 333 990 A1 7/1977
KR 10-2011-0107728 A1 10/2011

OTHER PUBLICATIONS

German Search Report (Application No. 10 2015 121 891.7) dated Sep. 21, 2016.
International Search Report and Written Opinion (Application No. PCT/EP2016/081200) dated Mar. 28, 2017.

* cited by examiner

SYSTEM COMPRISING AN ELECTRICALLY OPERATED HANDHELD DEVICE AND A TRANSPORT CASE FOR THE HANDHELD DEVICE, AND METHOD FOR OPERATING A HANDHELD DEVICE

CROSS REFERENCE TO RELATED APPLICATIONS

This application is a continuation of International Application No. PCT/EP2016/081200 filed Dec. 15, 2016, which designated the United States, and claims the benefit under 35 USC § 119(a)-(d) of German Application No. 10 2015 121 891.7 filed Dec. 15, 2015, the entireties of which are incorporated herein by reference.

FIELD OF THE INVENTION

The present invention relates to a system, a transport case, and a method for operating an electrically operated handheld device.

BACKGROUND OF THE INVENTION

The prior art discloses systems which comprise an electrically operated handheld device, which is designed, in particular, in the form of a handheld hot-air device or in the form of a handheld grinder, and a transport case for accommodating, and for transporting, the handheld device.

SUMMARY OF THE INVENTION

The present invention is based on the object of proposing a system made up of an electrically operated handheld device, which is designed, in particular, in the form of a handheld hot-air device or in the form of a handheld grinder, and of a transport case and of proposing a transport case, wherein the transport case has an additional use, without its stacking capability being restricted. It is a further object of the present invention to propose a method for operating an electrically operated handheld device, which is designed, in particular, in the form of a handheld hot-air device or in the form of a handheld grinder, it being possible for the method to allow the user to broaden the scope for using the handheld device.

In the case of the system according to the present invention comprising an electrically operated handheld device, which is designed, in particular, in the form of a handheld hot-air device or in the form of a handheld grinder, and a transport case for the handheld device, and in the case of which the transport case comprises at least one first case shell, provision is made for the at least one first case shell to comprise an outer side, wherein, in its outer side, the case shell comprises a depression for partially accommodating the handheld device, and wherein the depression extends in the direction of a stowage space of the transport case. It is thus possible for the handheld device to be arranged on an outer side of the transport case and for the transport case thus to be used in the form of a holder for the handheld device. The depression here is formed, in particular, in the base wall of the case shell. The option of arranging part of the handheld device in the depression of the transport case makes it possible for the user to prepare the handheld device for use or to park the handheld device during a break in operation, or to allow the handheld device to cool down following operation, without the user having to use other objects to create auxiliary structures for arranging the handheld device properly. Furthermore, arranging the handheld device in the depression of the transport case when the handheld device is activated also means that an object which is to be machined using the handheld device can be moved by both the user's hands in the hot-air jet of the handheld hot-air device or in relation to a grinding tool. Forming the depression on the at least one case shell means that the outer dimensions of the transport case are not altered, and nor is the stacking capability of the transport case influenced by the depression.

Provision is also made for the transport case to comprise the first case shell and a second case shell, wherein the depression is arranged on the first case shell between a handle of the transport case and a hinge pin of the transport case, the hinge pin connecting the two case shells. Such positioning makes it possible for the user to hold the transport case by its handle when the handheld hot-air device is being inserted into the depression and removed from the depression, and therefore the two objects can be moved in a specific manner in relation to one another and quick and problem-free connection and separation of the transport case and handheld hot-air device are possible. In addition to the second case shell being of tub-like design, it is also possible here to provide for a flat, board-like design of the second case shell.

Provision is also made for the case shell which has the depression to be of tub-like design, wherein the depression is arranged on a base wall of the case shell, and therefore the depression forms an elevation in the tub-like case shell. Such a design of the depression means that outer dimensions of the transport case or of the case shell are not adversely affected. Rather, it is possible for the depression to be arranged in regions which, for example, on account of the overall geometry of the handheld hot-air device, are not required as stowage space in an interior of the transport case.

Provision is also made to arrange the depression centrally in the base wall of the case shell, wherein the base wall of the case shell is enclosed by side walls. It is thus possible for the transport case or the case shell, with the handheld hot-air device arranged in its depression, to display a high level of stability.

Provision is also made so that, in an operating position, that is to say a position in which the handheld hot-air device is arranged in the depression, a form fit is established between the at least one case shell and a handle of the handheld hot-air device and/or a fan portion of the handheld hot-air device. This means that the handheld hot-air device is retained, by way of a region which is remote from its hot-air nozzle, in a particularly reliable manner on the case shell or the transport case. Of course, apart from the hot-air nozzle, it is also possible for all the other parts of the handheld hot-air device to be used to establish a form fit.

As an alternative, provision is also made for the handheld hot-air device to comprise at least one retaining means, and, in the depression, for the at least one case shell to comprise at least one mount for the retaining means. As a result, the handheld hot-air device is retained in a reliable manner, and with the aid of a straightforward coupling and uncoupling operation, on a case shell or the transport case. Other embodiments of retaining means and mount are also provided as an alternative. The retaining means and mount can also be formed, for example, by the components of a bayonet connection.

Provision is made so that, in an operating position, the handheld hot-air device can have an end which is directed away from its hot-air nozzle accommodated in the depression. This ensures that a distance is maintained between a hot-air nozzle of the handheld hot-air device and the case shell or the transport case in the operating position and prevents thermal damage to the case shell.

Provision is also made for a fan portion of the handheld hot-air device to comprise at least one air-intake opening, wherein the handheld hot-air device and the at least first case shell are adapted to one another such that, in an operating position, air enters without obstruction into the at least one air-intake opening. This allows unimpaired operation of the handheld hot-air device in the operating position in which the handheld hot-air device is arranged on the case shell or the transport case.

Provision is also made for the handheld hot-air device to be designed in the form of a heat gun and for the heat gun to be provided with a handle, wherein, in an operating position, the heat gun butts against the transport case by way of an underside of the handle and/or a rear side of the handle. This provides for additional stabilization of the heat gun in the operating position. Furthermore, the forces for transmission between the transport case and the heat gun are distributed over more points, and this makes it possible to reduce peak loads of the heat gun and of the case shell or of the transport case.

In respect of the depression, provision is made for the latter to be designed in the manner of a bowl with a periphery running all the way round, or for it to be designed in the form of a slot with a lateral inlet, or for it to be designed in the form of a slot with a lateral inlet and a lateral outlet. A tub-like design has the advantage that it least reduces the interior volume of the transport case. Slot-like depressions have the advantage that they make it possible, in a manner which can easily be understood, for the handheld hot-air device to be pushed in linearly to reach the operating position, and they therefore provide for intuitive handling.

Provision is also made so that, in an operating position of the handheld hot-air device, an axis of a hot-air jet which can be generated by the handheld hot-air device is at an angle of 20° to 90°, and, in particular, at an angle of 45° to 90°, to a base wall of the case shell and is directed away from the base wall. It is assumed here that the closed transport case rests on a horizontally oriented underlying surface by way of a base wall of the second case shell, the base wall being located opposite the base wall of the first case shell. Such angular positionings of the handheld hot-air device make it possible for a user to handle an object ergonomically in the hot-air jet.

Finally, provision is made so that, in its operating position, the handheld hot-air device can be connected in a releasable manner to the case shell, and, in particular, to the depression of the case shell, by at least one latching means, wherein the latching means is arranged, in particular, between the case shell and a handle of the handheld hot-air device or between the depression and a fan portion of the handheld hot-air device. Latching the handheld hot-air device and case shell or transport case creates a particularly reliable connection between these two components, and therefore, for example, for the purpose of shifting a floor-standing unit formed from the handheld hot-air device and the transport case, all that is required is for just the transport case, or just the handheld hot-air device, to be gripped. This significantly facilitates handling of the floor-standing unit.

The transport case according to the present invention for an electrically operated handheld device, which is designed, in particular, in the form of a handheld hot-air device or in the form of a handheld grinder, the transport case comprising at least one first case shell, is distinguished in that the at least one first case shell comprises an outer side, wherein, in its outer side, the case shell comprises a depression for partially accommodating the handheld device, and wherein the depression extends in the direction of a stowage space of the transport case. It is thus possible for the handheld device to be arranged on an outer side of the transport case and thus for the transport case to be used as a holder for the handheld device. The option of arranging the handheld device in the depression of the transport case makes it possible for the user to prepare the handheld device for use or to park the handheld device during a break in operation, or to allow the handheld device to cool down following operation, without the user having to use other objects to create auxiliary structures for arranging the handheld device properly. Furthermore, arranging the handheld device in the depression of the transport case when a handheld device is activated also means that an object which is to be machined using the handheld device can be moved by both the user's hands in the hot-air jet of the handheld hot-air device or in relation to a rotating grinding tool of the handheld grinder. Forming the depression on the at least one case shell means that the outer dimensions of the transport case are not altered, and nor is the stacking capability of the transport case influenced by the depression.

In respect of the system, provision is also made so that, in its operating position, the handheld grinder can be connected in a releasable manner to the case shell, and, in particular, to the depression of the case shell, by at least one latching means and/or at least one clamping means, wherein, in its latching position, the handheld grinder is oriented in relation to the transport case such that the course followed by a half-line which forms an extension of a drive shaft of the handheld grinder is unimpeded by the transport case, and/or in that a grinding tool which is coupled to the handheld grinder can be rotated in a contact-free manner in relation to the transport case. This system makes it possible for the handheld grinder to be used for a multiplicity of further applications, and thus increases the use value of the handheld grinder to a considerable extent.

The method according to the present invention for operating a handheld device, which is designed, in particular, in the form of a handheld hot-air device or in the form of a handheld grinder, provides for the handheld device to be connected to a depression, arranged on an outer side of the transport case, such that the handheld device is retained such that a user can handle a workpiece in a hot-air jet, which can be generated by the handheld device, or in relation to a grinding tool, which can be rotated by the handheld device, without having to hold the handheld device. A further possible application is created here solely by the components of the system.

Within the context of the present invention, a transport case comprises a stowage space or interior, in which the handheld hot-air device and possibly accessories are accommodated for transportation and storage purposes. The stowage space is bounded by inner sides of the case shells.

Within the context of the present invention, a handheld hot-air device is understood to be a heat gun and, in particular, also a hot-air rod.

BRIEF DESCRIPTION OF THE DRAWINGS

Further details of the present invention will be described in the drawing with reference to schematically illustrated exemplary embodiments.

DETAILED DESCRIPTION OF THE INVENTION

Figure 1:
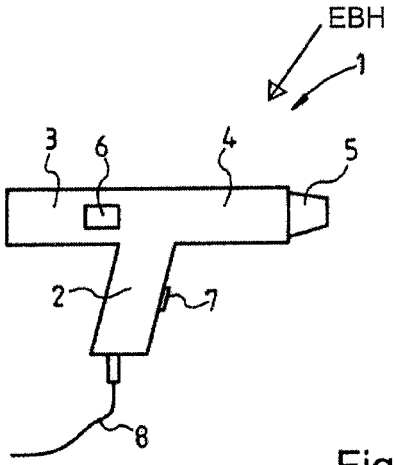
FIGS. 1 to 4 show a first variant of a system according to the present invention.

FIG. 1 illustrates a side view of a handheld hot-air device HLG in the form of a heat gun 1. The handheld hot-air device HLG or the heat gun 1 is designed in the form of an electrically operated handheld device EBH. The heat gun 1 comprises a handle 2, a fan portion 3, a heating portion 4 and a hot-air nozzle 5. The heat gun 1 also comprises an air-intake opening 6, in the fan portion 3, a switching device 7, on the handle 2, and an electric cable 8, which is routed within the handle 2.

Figure 2:
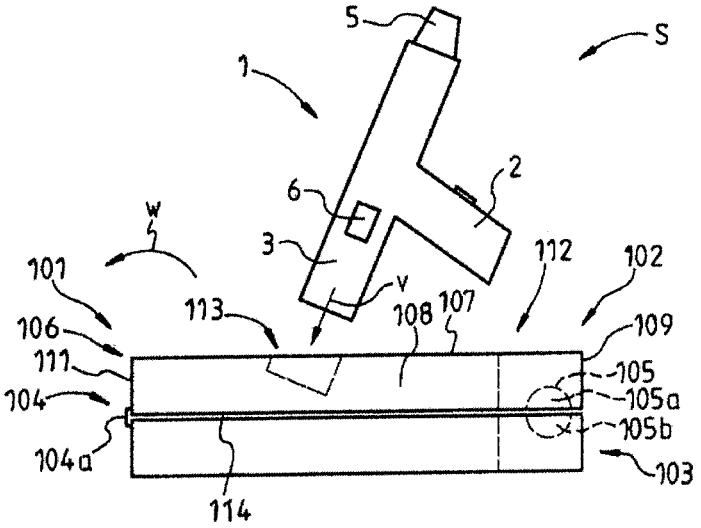

The heat gun 1 is illustrated again in FIG. 2 and, together with the transport case 101 shown there, forms a system S. The transport case 101 comprises a first case shell 102 and a second case shell 103. The two case shells 102, 103 are connected to one another by means of a hinge 104 such that they can be pivoted about a hinge pin 104*a*, it therefore being possible for the transport case 101, once unlocked, to be swung open by virtue of the first case shell 102 being pivoted in arrow direction w. A handle 105 here separates into a first handle half 105*a*, which is formed on the first case shell 102, and a second handle half 105*b*, which is formed on the second case shell 103. The first case shell 102 is designed in the form of a tub 106, or tub-like case shell 102, and a has a base wall 107, which is surrounded by four side walls 108, 109, 110 and 111 (see also FIG. 4). The base wall 107 and the side walls 108-111 form an outer side 112 of the first case shell 102. On this outer side 112 of the first case shell 102, a depression 113 is formed in the region of the base wall 107, the depression being directed into an interior or stowage space 114 of the transport case 101. The depression 113 is dimensioned, and oriented, such that the heat gun 1 can have its fan portion 3, which is located opposite its hot-air nozzle 5, inserted into the depression 113 in an arrow direction v, as indicated in FIG. 2, wherein FIG. 2 illustrates the heat gun 1, for reasons of simplicity, without an electric cable.

Figure 3:
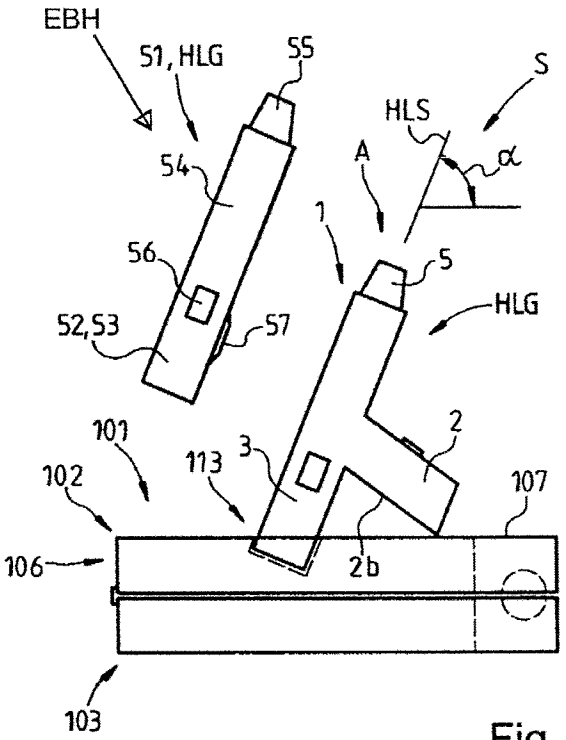

The fully inserted heat gun 1 is then shown in FIG. 3, wherein that position of the heat gun 1 which is shown in FIG. 3 is referred to as operating position A. In order for the position of the heat gun 1 to be shown clearly in FIG. 3, the contour of the heat gun is illustrated by solid lines even in the region of the depression 113. It can also be seen in FIG. 3 that the heat gun 1 rests on the base wall 107 of the upper case shell 102 by way of a rear side 2*b* of its handle 2, the operating position A of the heat gun 1 being stabilized as a result.

In the operating position A of the heat gun 1, an axis of a hot-air jet HLS (see FIG. 3), which can be generated by the heat gun 1, is at an angle $\alpha$ of 67° to the base wall 107 of the first case shell 102 and is directed away from the base wall 107.

FIG. 3 also shows, as an alternative to the heat gun 1, a handheld hot-air device in the form of a hot-air rod 51, which, along with the transport case 101, likewise forms a system S. The hot-air rod likewise forms an electrically operated handheld device EBH. The hot-air rod 51 comprises a handle 52, which at the same time forms a fan portion 53, and also comprises a heating portion 54 and a hot-air nozzle 55. The hot-air rod 51 further comprises an air-intake opening 56, and a switching device 57, in the fan portion 53, and an electric cable (not illustrated). Like the heat gun 1, the hot-air rod 51 can likewise be inserted into the depression 113, so as to be retained in an operating position by the transport case 101.

Figure 4:
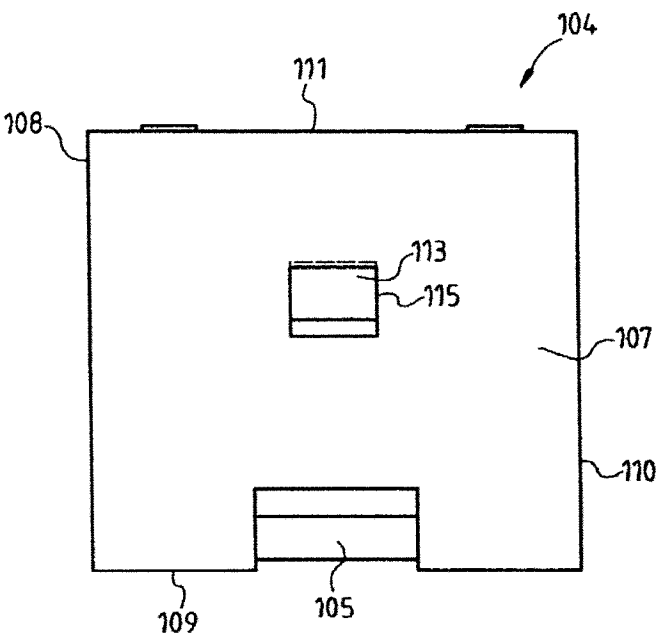

The aforementioned FIG. 4 illustrates the transport case 101, which has already been shown in FIGS. 2 and 3, in a plan view of its base wall 107. This plan view once again shows the depression 113, which is adapted to a rectangular cross section of the fan portion of the heat gun. The depression 113 has a periphery 115 running all the way round.

Figures 5, 6:
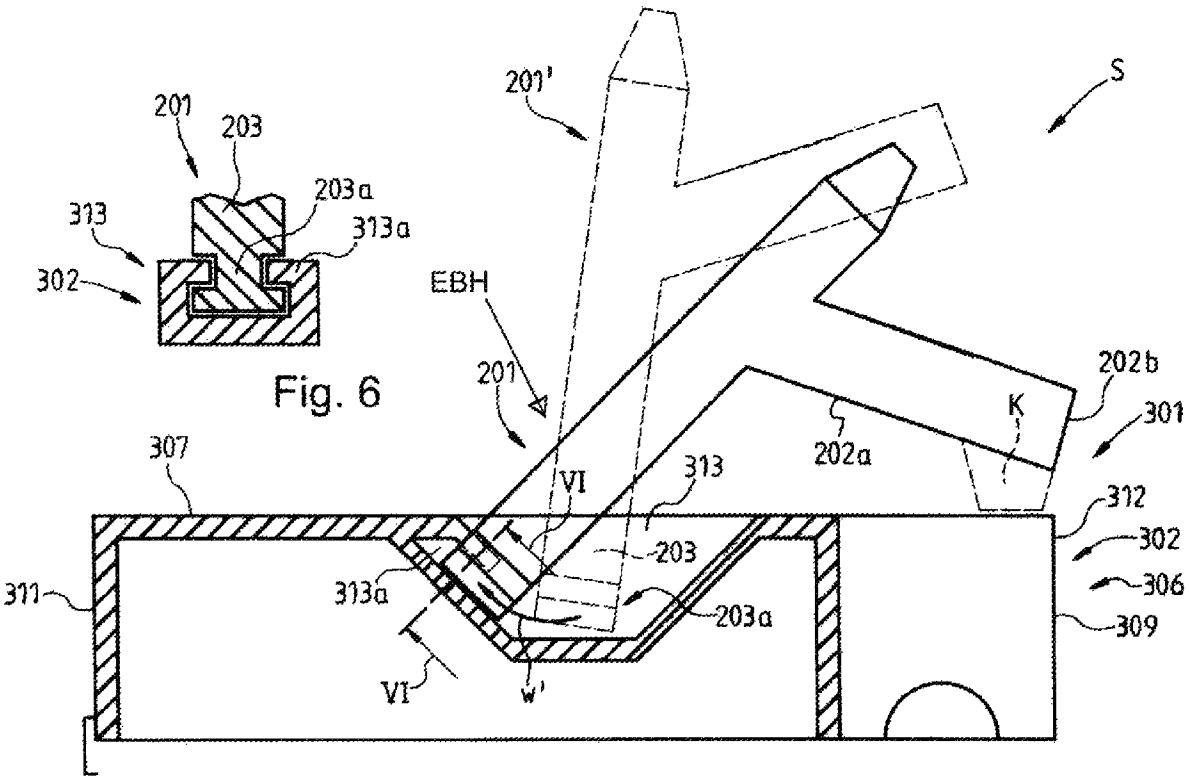
FIGS. 5 and 6 show a second variant of a system according to the present invention.

FIGS. 5 and 6 show a second variant of a system S according to the present invention. For reasons of simplicity, only a first, upper case shell 302 of a transport case 301 is shown, in lateral section, the section being taken in the region of a depression 313 of the first case shell 302.

The first case shell 302, once again, is designed in the form of a tub 306, or tub-like case shell 302, and has a base wall 307, which is surrounded by four side walls 309, 311, only two side walls being visible in the sectional illustration. The base wall 307 and the side walls 309, 311 form an outer side 312 of the first case shell 302. The same heat gun is depicted once by dashed lines, being designated heat gun 201', and once by solid lines, being designated heat gun 201. The heat gun 201 is designed in the form of an electrically operated handheld device EBH. The heat gun 201 here is shown in an operating position A, in which the heat gun 201 is retained on the transport case 301. As the dashed illustration shows, the heat gun 201' is first of all placed, by way of its fan portion 203, approximately vertically into the depression 313 and is then pivoted in arrow direction w', and therefore a retaining means 203*a* of the fan portion 203, the retaining means being designed in the form of a waisted end, is introduced into a mount 313*a*, which is formed in the depression 313 and is configured in the form of a T-shaped guide. It is optionally the case that a handle 202 of the heat gun 201 has, on a rear side 202*b*, a contact element K, by way of which the heat gun 201 then rests, in the operating position A, on the base panel 307 of the first case shell 302. According to one variant, provision is also made for the handle 202 to rest on the base panel by way of an underside 202*a* or to butt against the side wall 309 by way of its rear side 202*b*.

The section VI-VI, which is indicated in FIG. 5, is illustrated schematically in FIG. 6, and it can therefore be seen how the retaining means 203*a* is guided in the mount 313*a*, which is formed on the first case shell 202. The heat gun 201 is removed from the depression 313 by virtue of the heat gun 201 being pivoted counter to the arrow direction w'.

Figure 8:
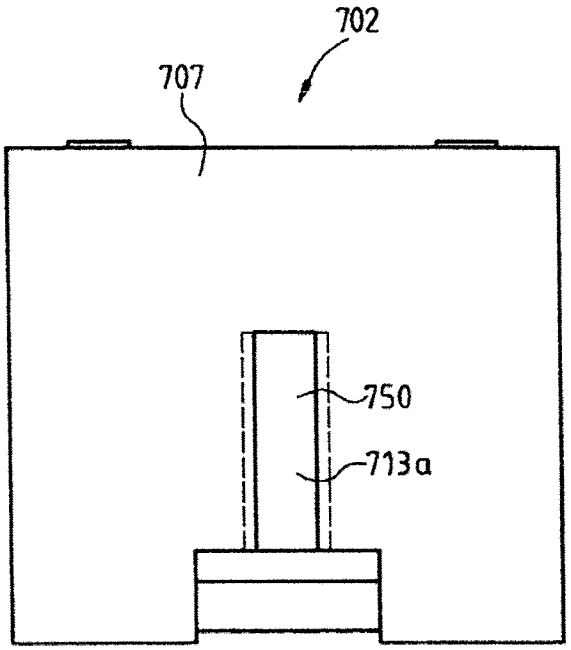
FIGS. 7 and 8 show two variants of depressions on case shells.
Figure 7:
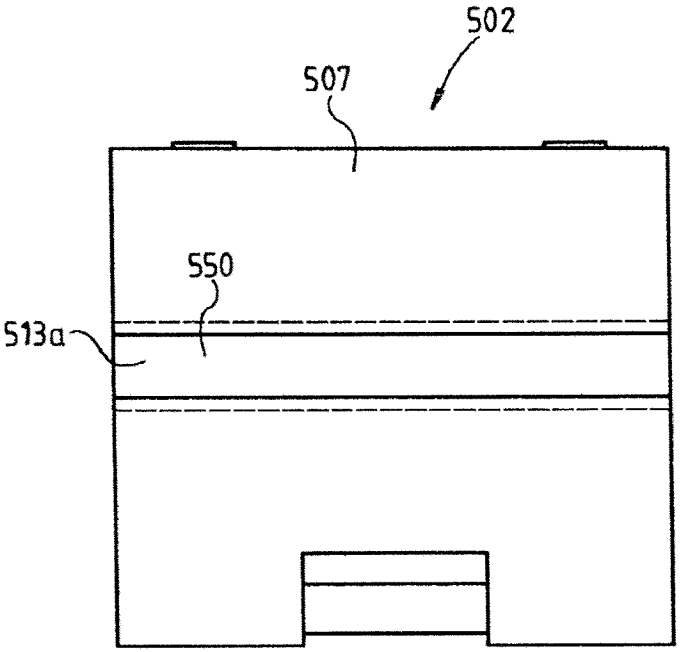

FIGS. 7 and 8 show first case shells 502 and 702 in plan views of their base panels 507 and 707, respectively. Both case shells 502, 702 have depressions 513 and 713, respectively, in the form of undercut guides 550 and 750, respectively, which form mounts 513*a* and 713*a*, respectively, and into which heat guns (not illustrated) can be pushed by way of a shoe-design retaining means. If the shoe is a rotationally symmetrical design, it is also possible for the respective heat gun to be rotated in the respective guide 550, 750 and oriented in accordance with requirements. A square design of the shoe provides for four options for connecting the transport case and heat gun. A rectangular design of the shoe provides for two options for connecting the transport case and heat gun. If the transport case and the heat gun are to be connected to one another just in one orientation, provision is made for the shoe and the guide to be coded correspondingly, in order, therefore, for incorrect installation to be avoided.

Figure 9:
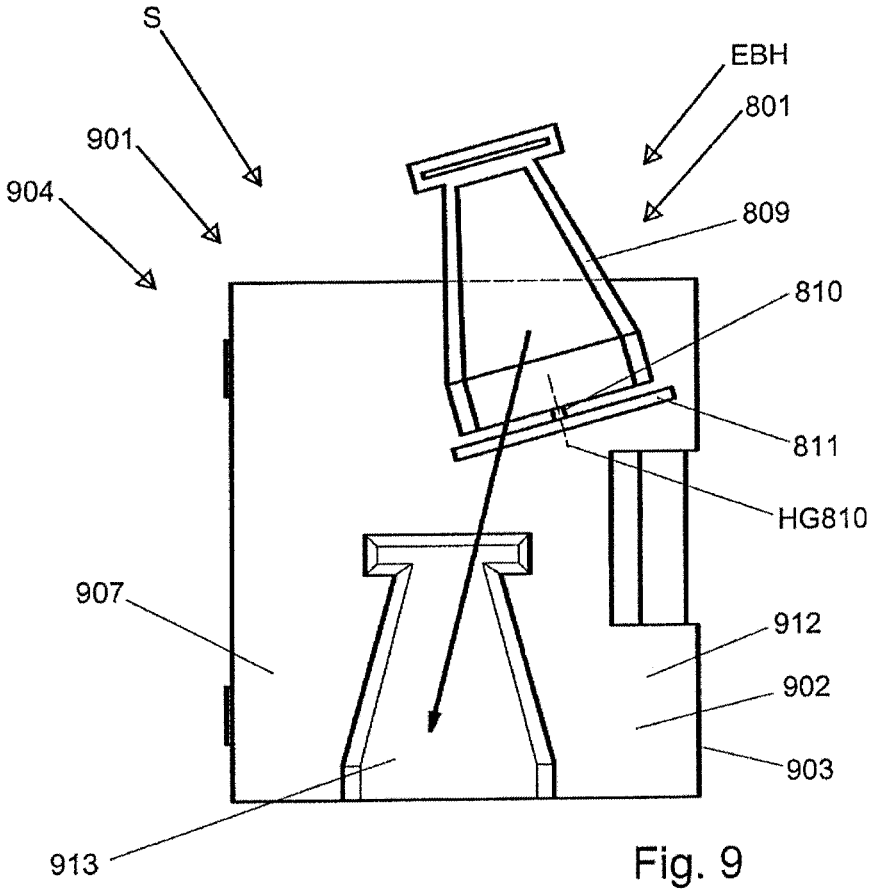
FIGS. 9-11 show a third variant of a system according to the present invention.
Figure 10:
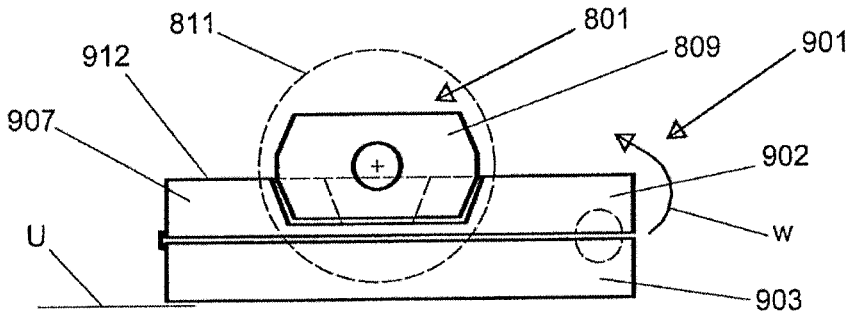

FIG. 9 illustrates, schematically, a side view of an electrically operated handheld device EBH in the form of a handheld grinder 801. The handheld grinder 801 comprises a housing 809, which can be gripped by hand, and a drive shaft 810, to which a grinding tool 811 is coupled. The handheld grinder 801 comprises an internal storage battery, but can also be connected to an external power source by an electric line. FIG. 9 also shows a plan view of a transport case 901, together with which the handheld grinder 801 forms a system S. The transport case 901 comprises a first case shell 902 and a second case shell 903. The two case shells 902, 903 are connected to one another in a pivotable manner by means of a hinge 904, it therefore being possible for the transport case 901, once unlocked, to be swung open by virtue of the first case shell 902 being pivoted in arrow direction w (see FIG. 10). An outer side 912 of the first case shell 902 has formed in it, in the region of a base wall 907, a depression 913 which opens laterally and in the upward direction, and is directed into an interior or stowage space of the transport case 901. The depression 913 is designed in the form of an open-periphery tub and is dimensioned, and oriented, such that the handheld grinder 801 can have approximately a third of its housing 809 inserted, as is illustrated in FIG. 10. FIG. 10 uses just a dashed line to indicate a grinding tool 811, it therefore being possible to see the housing 809 located in the depression 913. The handheld grinder 801 is retained by the transport case 901 such that, in the fixed state of the handheld grinder 801 which is shown in FIG. 10, the grinding tool 811 can rotate freely in relation to the transport case 901 and in relation to an underlying surface U, on which the transport case 901 rests, and therefore the user need not hold the handheld grinder 801 while the latter is operating. The course followed by a half-line HG810 which extends from the drive shaft 810 is unimpeded by the transport case 901 when the handheld grinder 801 is retained in the depression 913 of the transport case 901.

Figure 11:
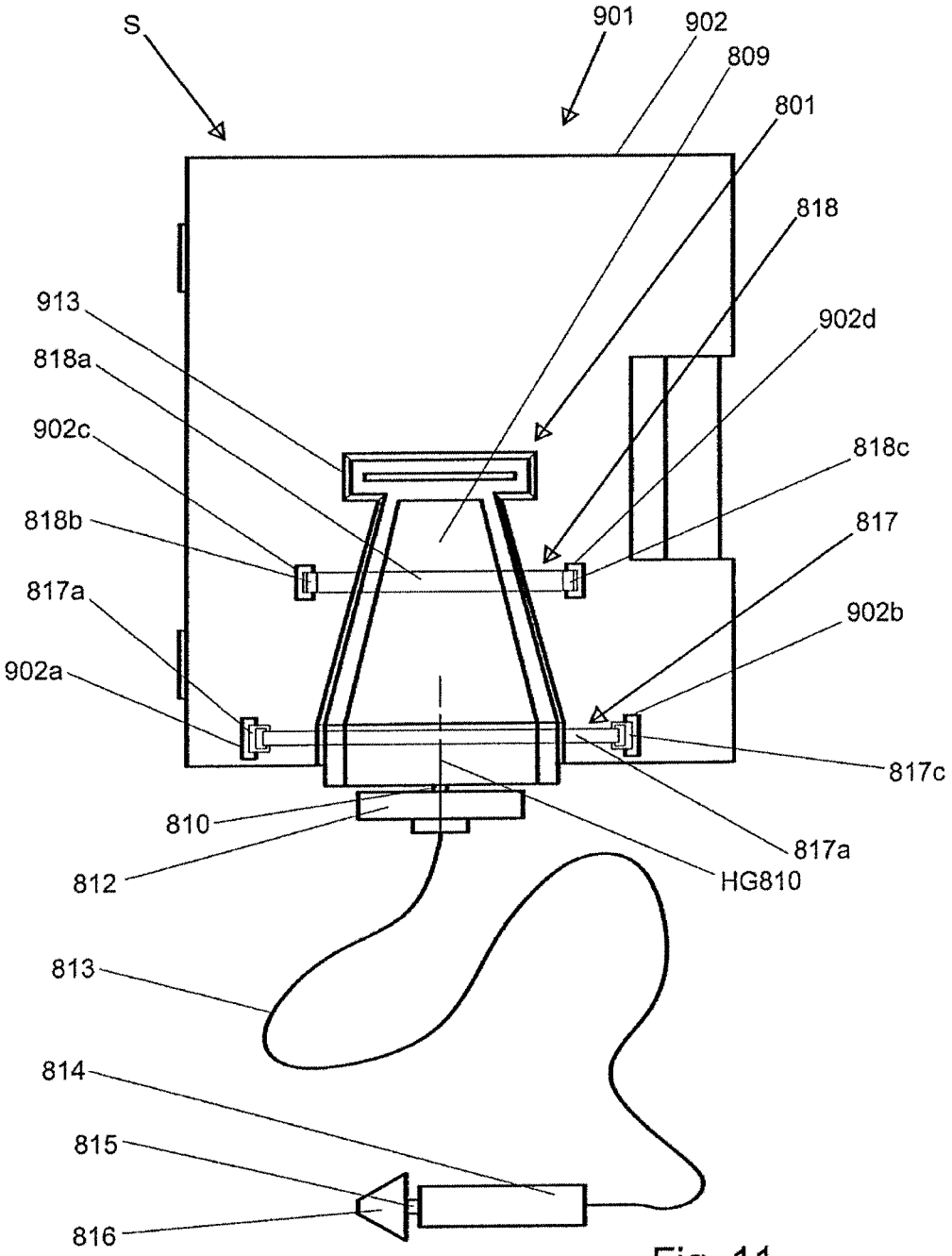

FIG. 11 shows how the housing 809 of the handheld grinder 801 is accommodated in the depression 913 of the transport case 901 and is thus maintained in an operating position. Instead of the disk-shaped grinding tool shown in FIGS. 9 and 10, the drive shaft 810 of the handheld grinder 801 now has connected to it, by means of an adapter 812, a flexible shaft 813, which runs through a grip piece 814 to a further adapter 815, to which a conical grinding tool 816 is coupled. This makes it possible for a user to concentrate fully on the grinding work in hand, since there is no need for him to hold the housing 809 of the handheld grinder 801. The user can thus use his free hand to handle, for example, a workpiece which is to be machined.

FIG. 11 illustrates an optionally present clamping means 817, which is designed in the form of a clamping strap 817*a* with end hooks 817*b* and 817*c*, by way of which said band can be fitted into recesses 902*a*, 902*b*, which are shown only in FIG. 11 and are formed in the first case shells 902.

FIG. 11 also illustrates an optionally present latching means 818, which is designed in the form of a bracket 818*a*. The bracket 818*a* is adapted to a geometry of the housing 809 and can be latched by way of its ends, which comprise elastically deformable resilient arms 818*b* and 818*c*, into recesses 902*c*, 902*d*, which are shown only in FIG. 11 and are formed in the first case shell 902.

The clamping strap 817*a* and the bracket 818*a* are illustrated in a transparent state in FIG. 11, and this means that the contour lines of the housing 809 of the handheld grinder 801 are not concealed.

LIST OF REFERENCE SIGNS

K Contact element on 202
S System
w Arrow direction
w' Arrow direction
v Arrow direction
A Operating position of 1, 201
HLS Hot-air jet HLS
HLG Handheld hot-air device
α Angle between 107 and HLS
1 Heat gun
2 Handle of 1
2*b* Rear side 2*b* of 2
3 Fan portion of 1
4 Heating portion of 1
5 Hot-air nozzle
6 Air-intake opening
7 Switching device
8 Electric cable
51 Hot-air rod
52 Handle of 51
53 Fan portion of 51
54 Heating portion of 51
55 Hot-air nozzle
56 Air-intake opening
57 Switching device
101 Transport case
102 First case shell
103 Second case shell
104 Hinge between 102 and 103
104*a* Hinge pin of 104
105 Handle
105*a* First handle half
105*b* Second handle half
106 Tub
107 Base wall of 106 and/or 102
108-111 Side wall of 106
112 Outer side of 102
113 Depression on 102
114 Interior or stowage space of 101
115 Periphery running all the way round 113
201 Heat gun (solid lines)
201' Heat gun (dashed lines)
202 Handle
202*a* Underside of 202
202*b* Rear side of 202
203 Fan portion
203*a* Retaining mechanism on 203
301 Transport case
302 First, upper case shell
306 Tub
307 Base wall of 306 and/or 302
309, 311 Side wall of 306
313 Depression on 302
313*a* Mount
502 Case shell
507 Base panel of 502
513 Depression
513*a* Mount
550 Guide
702 Case shell

707 Base panel of 702
713 Depression
713*a* Mount
750 Guide
801 Handheld grinder
809 Housing
810 Drive shaft
811 Grinding tool
812 Adapter
813 Flexible shaft
814 Grip piece
815 Further adapter
816 Conical grinding tool
817 Clamping mechanism
817*a* Clamping strap
817*b*, 817*c* Hook
818 Latching mechanism
818*a* Bracket
818*b*, 818*c* Resilient arm
901 Transport case
902 First case shell
902*a*, 902*b* Recess for 817
902*c*, 902*d* Recess for 818
903 Second case shell
904 Hinge
907 Base wall
912 Outer side
913 Depression
EBH Electrically operated handheld device
HG810 Half-line extending from 810
w Arrow direction

The invention claimed is:

1. A system comprising an electrically operated handheld device and a transport case for the handheld device, wherein the transport case comprises a first case shell having an outer side, a second case shell, and a depression for partially accommodating the handheld device, wherein the depression one of extends in the direction of a stowage space of the transport case, or is arranged on the first case shell between a handle of the transport case and a hinge pin of the transport case, said hinge pin connecting the first and second case shells, wherein the handheld device is a hot-air device, wherein one of an operating position, a form fit is established between the first case shell and one of a handle of the handheld hot-air device or a fan portion of the handheld hot air device, or in the operating position the handheld hot air device has an end which is directed away from a hot air nozzle accommodated in the depression, wherein the handheld hot air device comprises at least one retaining mechanism, and wherein the depression of the first case shell includes at least one mount for the retaining mechanism.

2. The system as claimed in claim 1, wherein the first case shell is of tub-like design, wherein the depression is arranged on a base wall of the first case shell.

3. The system as claimed in claim 2, wherein the depression is arranged centrally in a base wall of the first case shell.

4. The system as claimed in claim 1, wherein the fan portion of the handheld device comprises at least one air-intake opening, wherein the handheld device and the first case shell are adapted to one another such that, in the operating position, air enters without obstruction into the at least one air-intake opening.

5. The system as claimed in claim 1, wherein the handheld device is designed in the form of a heat gun and comprises the handle, wherein, in the operating position, the handheld hot-air device butts against the transport case by way of one of an underside of the handle or a rear side of the handle.

6. The system as claimed in claim 1, wherein the depression is designed in the manner of a bowl with a periphery running all the way round, or wherein the depression is designed in the form of a slot with a lateral inlet, or wherein the depression is designed with a lateral inlet and a lateral outlet.

7. The system as claimed in claim 1, wherein in the operating position of the handheld hot-air device, an axis of a hot-air jet which can be generated by the handheld hot-air device defines an angle of 20° to 90° to a base wall of the first case shell and is directed away from a base wall.

8. The system as claimed in claim 1, wherein, in the operating position, the handheld hot-air device can be connected in a releasable manner to the first case shell by at least one latching mechanism, wherein the at least one latching mechanism is arranged between the first case shell and the handle of the handheld hot-air device or between the depression and the fan portion of the handheld hot-air device.

9. The system as claimed in claim 7, wherein the angle is 45° to 90°.

10. The system as claimed in claim 8, wherein the handheld hot-air device is connected to the depression of the first case shell.

* * * * *